US006296166B1

(12) United States Patent
Huang

(10) Patent No.: US 6,296,166 B1
(45) Date of Patent: Oct. 2, 2001

(54) BELT FEEDING DEVICE FOR STAPLER

(76) Inventor: Shih Chang Huang, No. 134, Yiau San Street, San Min Chu, Kaoshiung, 807 (TW)

( * ) Notice: Subject to any disclaimer, the term of this patent is extended or adjusted under 35 U.S.C. 154(b) by 0 days.

(21) Appl. No.: 09/771,601

(22) Filed: Jan. 30, 2001

(51) Int. Cl.[7] ..... B25B 23/04

(52) U.S. Cl. ..... 227/119; 227/120; 227/136; 81/57.37; 81/434

(58) Field of Search ..... 227/119, 120, 227/135, 136, 137, 142; 81/57.37, 434, 433, 435

(56) References Cited

U.S. PATENT DOCUMENTS 3,891,014 * 6/1975 Gunn ..... 81/57.37
4,404,877 * 9/1983 Mizuno et al. ..... 227/136
5,101,697 * 4/1992 Fishback ..... 81/434
5,284,074 * 2/1994 Chen ..... 81/434
5,402,695 * 4/1995 Hornung ..... 81/434
5,671,645 * 9/1997 Murayama et al. ..... 81/434
6,073,523 * 6/2000 Shinjo ..... 227/136
6,227,429 * 5/2001 Huang ..... 227/119

* cited by examiner

*Primary Examiner*—Scott A. Smith
(74) *Attorney, Agent, or Firm*—Charles E. Baxley

(57) ABSTRACT

A belt feeding device for feeding a belt of a stapler includes a casing slidable and movable inward and outward of a housing and having a guide passage for receiving the belt. A rotary member is unidirectionally secured on in the casing with a shaft and includes a number of outer projections for engaging with and for feeding the belt step by step. The rotary member may be rotated relative to the casing step by step when the casing moves inward and outward of the housing. A spring member may be engaged with the rotary member for positioning the rotary member to said casing.

7 Claims, 5 Drawing Sheets

BELT FEEDING DEVICE FOR STAPLER

BACKGROUND OF THE INVENTION

1. Field of the Invention

The present invention relates to a stapler, and more particularly to a stapler having a belt feeding device for precisely feeding the belt and the nails or fasteners step by step.

2. Description of the Prior Art

Various kinds of typical staplers have been developed and comprise a belt feeding device for actuating or feeding the belt and the fasteners or screws step by step or one by one. However, the belt feeding device normally includes a spring biased pawl or pusher for engaging with and for pushing the belt and thus the fasteners forward step by step. However, the belt and the fasteners are normally loosely retained in the stapler and may not be precisely pushed forward by the spring biased pawl.

The present invention has arisen to mitigate and/or obviate the afore-described disadvantages of the conventional staplers.

SUMMARY OF THE INVENTION

The primary objective of the present invention is to provide a stapler including a belt feeding device for precisely feeding the belt and the nails or fasteners step by step.

In accordance with one aspect of the invention, there is provided a belt feeding device for feeding a belt of a stapler, the belt feeding device comprising a housing, a casing slidably engaged in the housing and movable inward and outward of the housing, the casing including a guide passage formed therein for receiving the belt, a shaft rotatably received in the casing, a rotary member unidirectionally secured on the shaft and to be rotated in an active direction by the shaft and to be rotated freely relative to the shaft in a reverse direction, the rotary member including an outer peripheral portion having a plurality of projections extended outward therefrom for engaging with and for feeding the belt, means for rotating the shaft relative to the casing to rotate the rotary member relative to the casing step by step when the casing moves inward and outward of the housing, and means for positioning the rotary member to the casing when the rotary member rotates relative to the casing step by step.

The positioning means includes a block secured to and rotated in concert with the rotary member, the block includes an outer peripheral portion having a plurality of recesses formed therein, and spring biasing means for engaging with the recesses of the block to position the rotary member to the casing.

The spring biasing means includes a spring secured to the casing and having a spring end engaged in the recesses of the block.

The rotary member includes two plates each having an outer peripheral portion and each having the projections extended outward from the outer peripheral portion thereof for engaging with and for feeding the belt.

The casing includes an orifice formed therein for receiving the shaft, and includes a curved groove formed therein and having a center of curvature located at the orifice of the casing, the housing includes a guide channel formed therein, the rotating means includes a rod secured to and rotated in concert with the shaft and slidably engaged in the curved groove of the casing and the guide channel of the housing for allowing the rod to be moved along the curved groove of the casing when the casing moves inward of the housing.

The rotating means includes an arm having a first end secured to the shaft and having a second end secured to the rod.

The housing includes at least one guide slot formed therein, the casing includes at least one protrusion extended therefrom and slidably received in the guide slot of the housing to guide the casing to move relative to the housing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
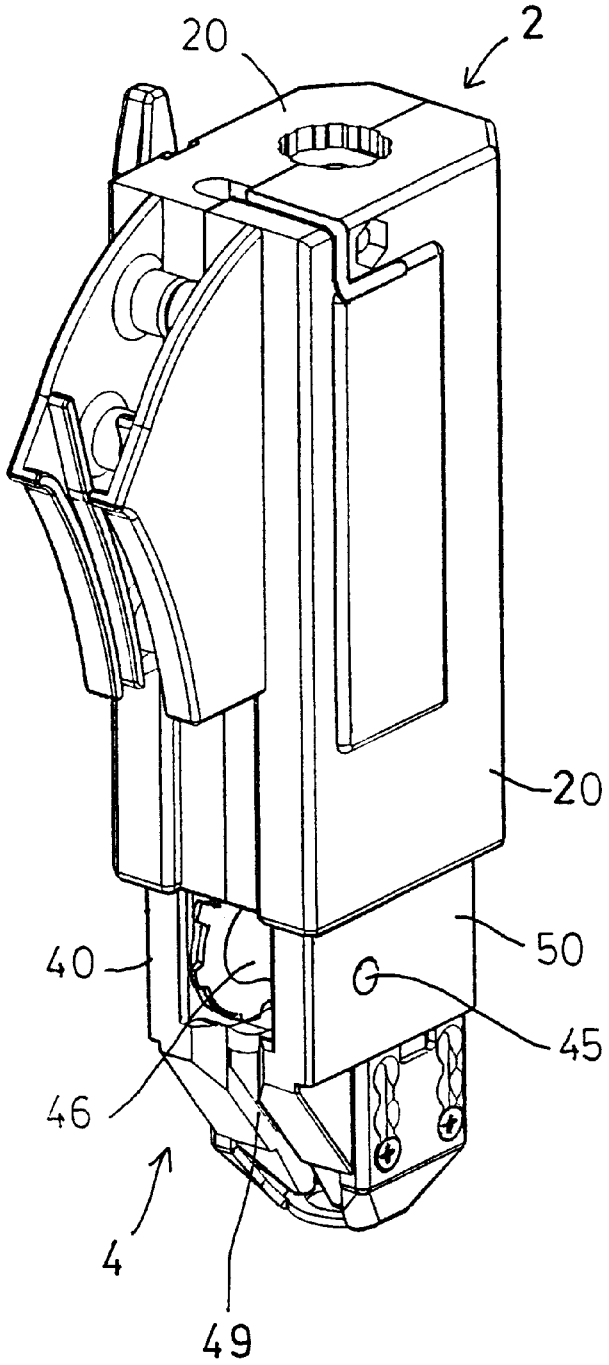
FIG. 1 is a perspective view showing a front portion of a stapler in accordance with the present invention.
Figure 2:
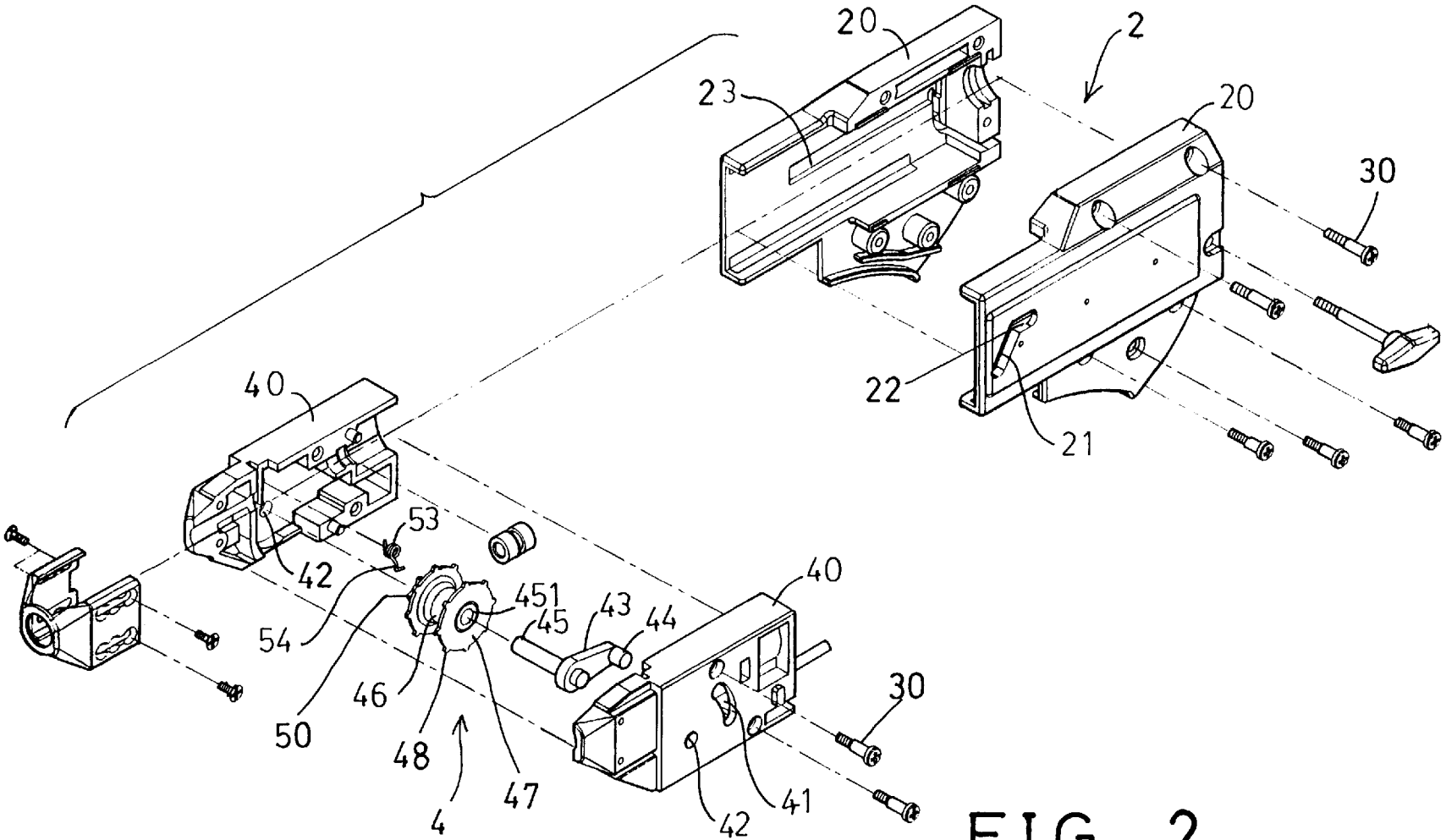
FIG. 2 is an exploded view of the belt feeding device.

Referring to the drawings, and initially to FIGS. 1–4, a stapler in accordance with the present invention comprises a housing 2 for attaching to the front portion of a typical stapler body and including one or more housing members 20 secured together with such as the fasteners 30. The stapler body is not related to the present invention and will not be described in further details. One of the housing members 20 includes a guide slot 23 (FIGS. 2, 3) formed therein, and the other housing member 20 includes a guide channel 21 is inclined relative to the longitudinal axis or direction of the housing 2 and having a section 22 parallel to the longitudinal axis or direction of the housing 2.

A casing 4 is slidably received in the housing 2 and includes two casing members 40 secured together with such as the fasteners 30. The casino 4 includes one or more protrusions 29 (FIG. 3) extended therefrom and slidably engaged in the guide slot 23 of the housing 2 for further guiding the casing 4 to move inward and outward of the housing 2 along the longitudinal axis of the housing 2 and/or of the casing 4. The casing 4 includes an orifice 42 formed therein, such as formed in each of the casing members 40. One of the casing members 40 includes a curved groove 41 formed therein and having a center of curvature located at the orifice 42 of the casing member 40.

Figure 4:
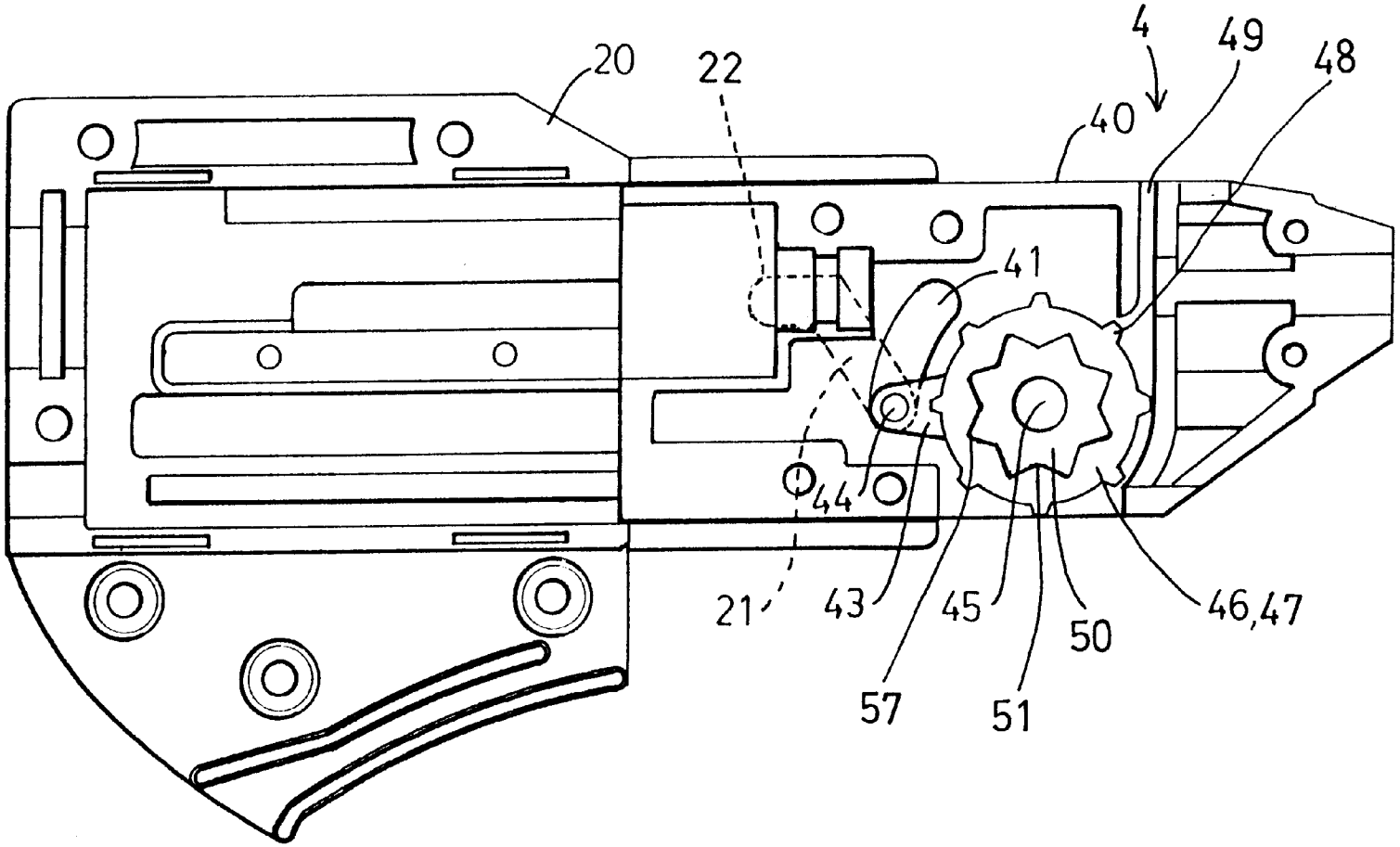
FIGS. 4 and 5 are plane schematic views of the front portion of the stapler as seen from the opposite side as that shown in FIG. 3, illustrating the belt or fasteners feeding operation of the belt feeding device.
Figure 5:
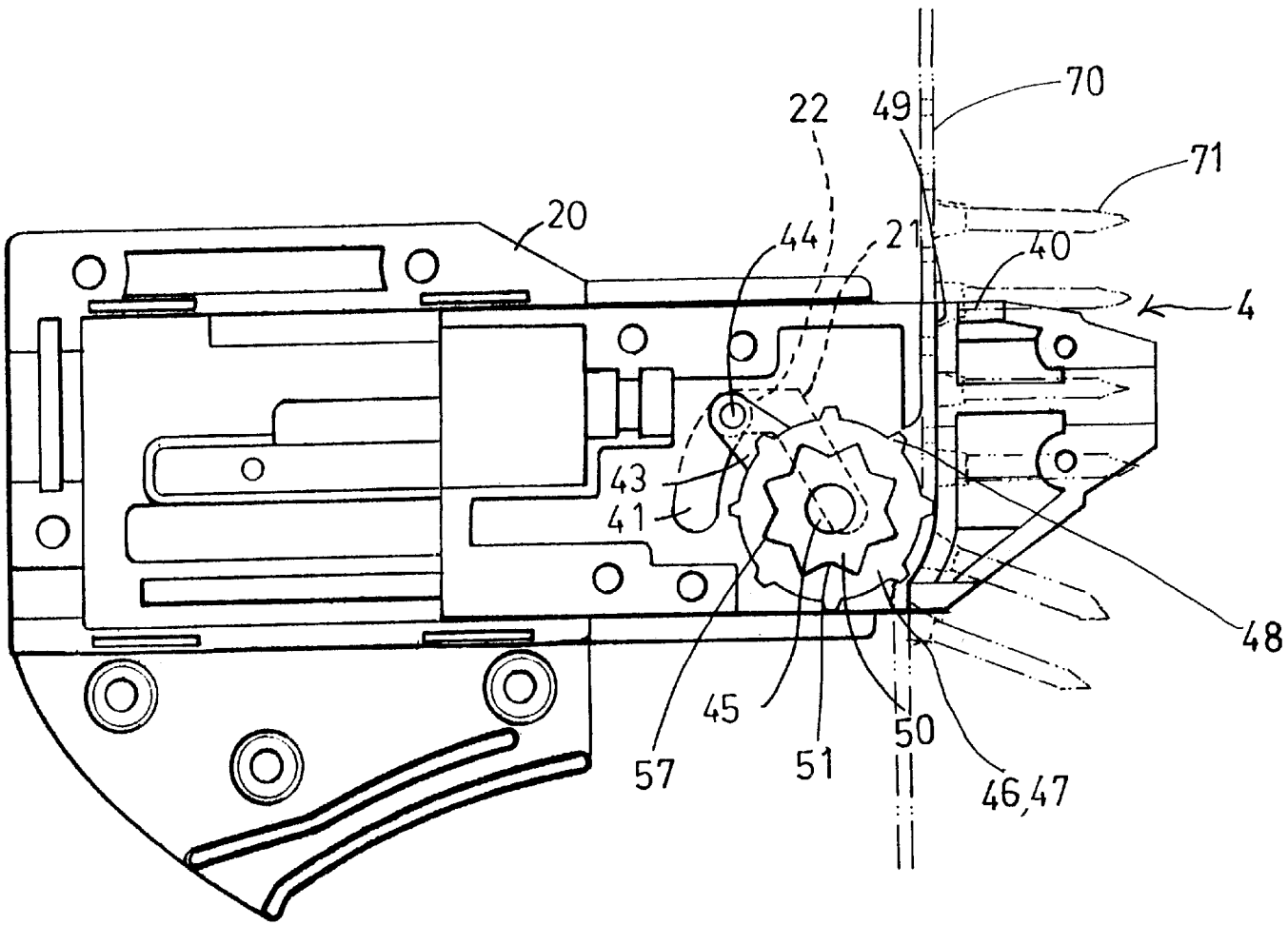

A shaft 45 has two ends rotatably engaged in the orifices 42 of the casing members 40. An arm 43 includes one end secured to the shaft 45 and rotated in concert with the shaft 45, and the other end having a rod 44 extended therefrom and slidably engaged through the curved groove 41 of the casing 4 and through the guide channel 21 and the guide channel section 22 of the housing 2 (FIGS. 4, 5). A rotary member 46, such as a pulley 46 is rotatably secured on the shaft 45 with a unidirectional bearing 451, for allowing the rotary member 46 to be rotated relative to the shaft 45 in one or in an active direction and to be prevented from rotating in the reverse direction. The casing 4 includes a guide passage 49 (FIGS. 4, 5) formed therein for slidably receiving the belt 70 (FIG. 5) that holds the typical fasteners 71, screws, nails or the like.

As shown in FIG. 1, the rotary member 46 includes one or more, particularly two plates 47 each having a number of projections 48 extended radially outward from the outer peripheral portion thereof for engaging with and for guiding and for feeding the belt 70 (FIG. 5) which normally includes two side edges each having a number of notches for receiving the projections 48 and for allowing the rotary member 46 to move and to feed the belt 70 forward step by step, or to feed the fasteners 71 forward one by one.

The rotary member 46 includes a block 50 secured to one side thereof and rotated in concert with the rotary member 46. The block 50 preferably includes an outer diameter smaller than that of the rotary member 46, particularly smaller than that of the plates 47 of the rotary member 46, and includes an outer peripheral portion having a number of recesses 51 formed therein and defined between a number of bulges or teeth 57. A spring 53 is engaged on a pin 52 (FIG. 3) of the casing 4 and includes one end 54 engaged with the teeth 57 or engaged in the recesses 51 of the block 50 (FIG. 3).

Figure 3:
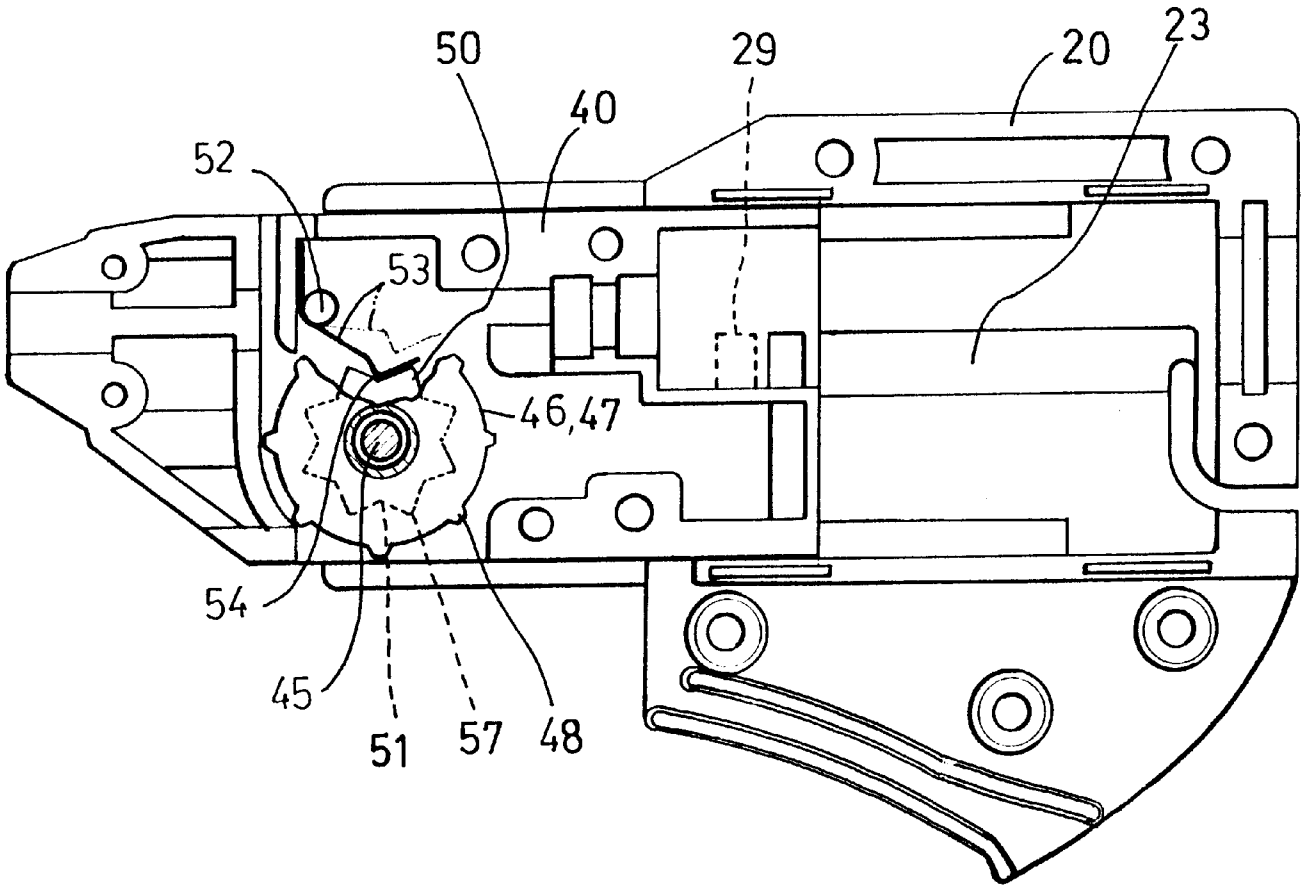
FIG. 3 is a plane schematic view as seen from one side of the front portion of the stapler, illustrating the structure of the belt feeding device.

It is to be noted that, as shown in FIG. 3, the numbers of the recesses 51 and the teeth 57 of the block 50 and the number of the projections 48 of the rotary member 46 are equal to each other, such that the engagement of the spring end 54 in the recesses 51 of the block 50 may be used to precisely feed the belt 70 forward step by step.

In operation, as shown in FIGS. 4 and 5, the rod 44 is slidably engaged in both the curved groove 41 of the casing 4 and the guide channel 21 and/or the guide channel section 22 of the housing 2. The casing 4 is normally biased outward of the housing 2 (FIG. 4) by a typical spring member of the stapler body and may be moved or forced inward of the housing 2 when the casing 4 is forced to engage with or against the work pieces to be stapled together. When the casing 4 is forced against the work piece to force and to move the casing 4 inward of the housing 2 (FIG. 5), the rod 44 may be forced and guided to move along both the curved groove 41 of the casing 4 and the guide channel 21 and/or the guide channel section 22 of the housing 2 and to move from one end to the other end of the curved groove 41 of the casing 4, such that the arm 43 and thus the rotary member 46 or the plates 47 of the rotary member 46 may be forced to rotate relative to the casing 4 by the shaft 45, for a predetermined rotating angle. The sliding engagement of the rod 44 in the curved groove 41 of the casing 4 may determine or limit the rotational movement of the shaft 45 and the arm 43 and the rotary member 46 relative to the casing 4.

When the casing 4 is removed or disengaged from the work piece, the casing 4 may be biased outward of the housing 2 (FIG. 4), and the rod 44 may be forced to move back toward the original end of the curved groove 41 such that the arm 43 and the shaft 45 may be rotated back in the reverse direction. The rotary member 46 will not be rotated in the reverse direction relative to the shaft 45 due to the unidirectional bearing 451 that is engaged between the shaft 45 and the rotary member 46. The rotary member 46 and thus the belt 70 may be rotated or moved forward step by step. The block 50 and the rotary member 46 are rotated in concert with each other such that the engagement of the spring end 54 in the recesses 51 of the block 50 may be used to precisely feed the belt 70 forward step by step.

Accordingly, the stapler in accordance with the present invention includes a belt feeding device for precisely feeding the belt and the nails or fasteners step by step.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A belt feeding device for feeding a belt of a stapler, said belt feeding device comprising:

a housing, a casing slidably engaged in said housing and movable inward and outward of said housing, said casing including a guide passage formed therein for receiving the belt, a shaft rotatably received in said casing, a rotary member unidirectionally secured on said shaft and to be rotated in an active direction by said shaft and to be rotated freely relative to said shaft in a reverse direction, said rotary member including an outer peripheral portion having a plurality of projections extended outward therefrom for engaging with and for feeding the belt, means for rotating said shaft relative to said casing to rotate said rotary member relative to said casing step by step when said casing moves inward and outward of said housing, and means for positioning said rotary member to said casing when said rotary member rotates relative to said casing step by step.

2. The belt feeding device according to claim 1, wherein said positioning means includes a block secured to and rotated in concert with said rotary member, said block includes an outer peripheral portion having a plurality of recesses formed therein, and spring biasing means for engaging with said recesses of said block to position said rotary member to said casing.

3. The belt feeding device according to claim 2, wherein said spring biasing means includes a spring secured to said casing and having a spring end engaged in said recesses of said block.

4. The belt feeding device according to claim 1, wherein said rotary member includes two plates each having an outer peripheral portion and each having said projections extended outward from said outer peripheral portion thereof for engaging with and for feeding the belt.

5. The belt feeding device according to claim 1, wherein said casing includes an orifice formed therein for receiving said shaft, and includes a curved groove formed therein and having a center of curvature located at said orifice of said casing, said housing includes a guide channel formed therein, said rotating means includes a rod secured to and rotated in concert with said shaft and slidably engaged in said curved groove of said casing and said guide channel of said housing for allowing said rod to be moved along said curved groove of said casing when said casing moves inward of said housing.

6. The belt feeding device according to claim 5, wherein said rotating means includes an arm having a first end secured to said shaft and having a second end secured to said rod.

7. The belt feeding device according to claim 1, wherein said housing includes at least one guide slot formed therein, said casino includes at least one protrusion extended therefrom and slidably received in said at least one guide slot of said housing to guide said casing to move relative to said housing.

* * * * *